US005991561A

United States Patent [19]

Okamoto et al.

[11] Patent Number: 5,991,561

[45] Date of Patent: Nov. 23, 1999

[54] APPARATUS AND METHOD FOR PREVENTING IMAGE TRANSFER TO AN AREA OF AN INTERMEDIATE TRANSFER BELT THAT IS SUSCEPTIBLE TO CREEP BUCKLING

[75] Inventors: Kenji Okamoto; Masayasu Kato, both of Toyokawa; Masato Togami, Toyohashi, all of Japan

[73] Assignee: Minolta Co. Ltd., Osaka, Japan

[21] Appl. No.: 08/970,380

[22] Filed: Nov. 14, 1997

[30] Foreign Application Priority Data

Nov. 15, 1996 [JP] Japan ..... 8-304865

[51] Int. Cl.[6] ..... G03G 15/00

[52] U.S. Cl. ..... 399/66; 399/298; 399/302

[58] Field of Search ..... 399/66, 298, 302, 399/303, 308

[56] References Cited

U.S. PATENT DOCUMENTS 5,652,948 7/1997 Sakaguchi et al. ..... 399/66

5,697,031 12/1997 Kamiya et al. ..... 399/302 X 5,740,492 4/1998 Deki et al. ..... 399/66

5,790,930 8/1998 Fuchiwaki ..... 399/302

*Primary Examiner*—William Royer

*Attorney, Agent, or Firm*—McDermott, Will & Emery

[57] ABSTRACT

An image-forming apparatus, and a method thereof, that transfers the toner image formed on the photoreceptor to an intermediate transfer belt in a first transfer area during a first transfer. When the first transfers of prescribed toner images to the intermediate transfer belt are completed, the intermediate transfer belt transfers the toner images obtained in the first transfers from the intermediate transfer belt to a recording medium in a second transfer area during a second transfer. Moreover, the area of the intermediate transfer belt that is susceptible to creep buckling (the 'creep buckling risk area') is prevented from passing through the first transfer area during the first transfer, thereby improving the image formation.

22 Claims, 12 Drawing Sheets

APPARATUS AND METHOD FOR PREVENTING IMAGE TRANSFER TO AN AREA OF AN INTERMEDIATE TRANSFER BELT THAT IS SUSCEPTIBLE TO CREEP BUCKLING

BACKGROUND OF THE INVENTION

1. Field of the Invention

The present invention pertains to an image-forming apparatus, and a method thereof, such as a copier or printer using the electrophotographic method. More particularly, an image-forming apparatus that has an intermediate transfer belt, wherein a toner image formed on a photoreceptor, via a electrophotographic process, is transferred to the intermediate transfer belt in a first transfer area, and when first transfers of prescribed toner images are completed, the toner images obtained in the first transfers undergo a second transfer to a recording medium in a second transfer area.

2. Description of Related Prior Art

Some electrophotographic image-forming apparatuses carry out a first transfer of the toner images formed on the photoreceptor to an intermediate transfer unit in a first transfer area, and when first transfers of prescribed toner images to the intermediate transfer unit are completed, they perform a second transfer of the toner images obtained in the first transfers from the intermediate transfer unit to a recording medium in a second transfer area.

An image-forming apparatus that forms multi-color images (full color images, for example) would be a representative example of the image-forming apparatus described above. In a multi-color image-forming apparatus, in order to overlap the toner images of each color that are sequentially formed on the photoreceptor before they are finally transferred to a recording medium, they are sequentially overlapped and transferred to an intermediate transfer unit in a first transfer area, so that the overlapping toner images thus formed on the intermediate transfer unit may be transferred to the recording medium in a second transfer area and fused.

In a full-color image-forming apparatus, for example, toner images of cyan, yellow, magenta and black are sequentially formed on the photoreceptor, such as a photoreceptor drum, via the electrophotographic process. Each time a toner image of a color is formed, it is first transferred to an intermediate transfer unit. After toner images of each color have been transferred to the intermediate transfer unit and overlapping toner images have been formed on the intermediate transfer unit, these overlapping toner images then undergo a second transfer to a recording medium and are fused.

An intermediate transfer belt that is suspended over a group of rollers, including a belt drive roller and first transfer roller, would be one example of the intermediate transfer unit described above.

Some of the issues to be resolved by the present invention are discussed below. However, a conventional image-forming apparatus adopting such an intermediate transfer belt has the following problem.

The intermediate transfer belt is suspended over a group of rollers including a belt drive roller, that are driven to rotate, and a first transfer roller that puts the intermediate transfer belt into contact with the photoreceptor surface in order to carry out the first transfer. However, when the belt stops, the intermediate transfer belt that is suspended over a group of rollers in this way may be subject to creep buckling at the area that is suspended over a small-diameter roller. If a toner image is transferred to this creep-buckled area in a first transfer, a defective first transfer can easily occur due to this deformation or to the fluctuation in the electrical resistance caused by the deformation. Thereby, causing the image finally obtained on the recording medium to also turn out defective.

To resolve these problems, while it is possible to increase the diameters of the rollers over which the belt is placed, such a solution would not satisfy the current demand for size reduction and compactness in an image-forming apparatus.

In order to achieve size reduction and compactness and to obtain nipping useful for the first transfer from the photoreceptor to the intermediate transfer belt, a small-diameter backup roller that presses the belt against the photoreceptor from the inside is sometimes placed near to and upstream from the first transfer roller in terms of the direction of movement of the belt. However, when this construction is used, the part of the belt between the small-diameter backup roller and the first transfer roller—particularly the part which is suspended over the small-diameter backup roller—often becomes susceptible to creep buckling.

SUMMARY OF THE INVENTION

Therefore, the object of the present invention is to provide an image-forming apparatus that carries out a first transfer of the toner image formed on the photoreceptor to an intermediate transfer belt in a first transfer area after the first transfers of prescribed toner images to the intermediate transfer belt are completed, a second transfer of the toner images obtained in the first transfers from the intermediate transfer belt to a recording medium in a second transfer area is performed, wherein the image-forming apparatus is designed such that the area of the intermediate transfer belt that is susceptible to creep buckling (the 'creep buckling risk area') does not pass the first transfer area during the first transfer and thereby good image formation may be carried out.

The means to resolve the aforementioned problem is discussed below.

An object of the present invention is to provide an image-forming apparatus, wherein during the first transfer in which the toner image is transferred from the photoreceptor to the intermediate transfer belt, the creep buckling risk area of the intermediate transfer belt does not pass the first transfer area, and the toner image is transferred to a normal belt area where there is no deformation so that the toner image is not transferred to the creep buckling risk area. Consequently, the present invention provides the advantage of forming a good-quality first transfer image, as well as a final image of good quality. The creep buckling risk area is used for a non-image formation area of the belt, and when this area passes the first transfer area, a first transfer of the toner image is not carried out.

Another object of the present invention is to provide an image-forming apparatus, wherein a backup roller that is in contact with the intermediate transfer belt from the inside is located near to and upstream from the first transfer area in terms of the direction of movement of the intermediate transfer belt. The belt area between the backup roller and the first transfer area when the intermediate transfer belt stops moving is the candidate for the creep buckling risk area. For this creep buckling risk area not to pass the first transfer area during the transfer operation in the first transfer area, the intermediate transfer belt is made to travel a prescribed distance Ls after the belt mark is detected by the belt mark detecting sensor, and is then stopped. This prescribed distance Ls is set such that it meets the following two conditions.

(1) Where L5<L11/2, $$[(Vs\times t20+L8+Vs/Vt)-L9+L7]<Ls<[(Vs\times t20+L8\times Vs/Vt)+L7]$$

(2) Where L5>L11/2, $$[(Vs\times t20+L8+Vs/Vt)-L9+L7-L11<Ls<[(Vs\times t20+L8\times Vs/Vt)+L7-L11]$$

In conditions (1) and (2) set forth above,

Ls=Vs×t30, and

Vs: speed of movement of the intermediate transfer belt t30: time between the detection of the belt mark by the belt mark detecting sensor and the stoppage of the belt Vt: speed of movement of the photoreceptor surface t20: time between the detection of the belt mark by the belt mark detecting sensor and the commencement of exposure of the photoreceptor L5: distance on the belt between the belt mark and the belt mark detecting sensor when the belt stops moving, measured along the direction of movement of the belt toward the downstream side L7: distance on the belt between the belt mark detecting sensor and the backup roller, measured along the direction of movement of the belt L8: distance on the photoreceptor between its exposure position and the first transfer area L9: length of the non-image formation area on the intermediate transfer belt, measured along the direction of movement of the belt L11: entire length of the intermediate transfer belt (=L9+length of image formation area L10)

The invention itself, together with further objects and attendant advantages, will be understood by reference to the following detailed description taken in conjunction with the accompanying drawings.

DETAILED DESCRIPTION OF THE INVENTION

Figure 1:
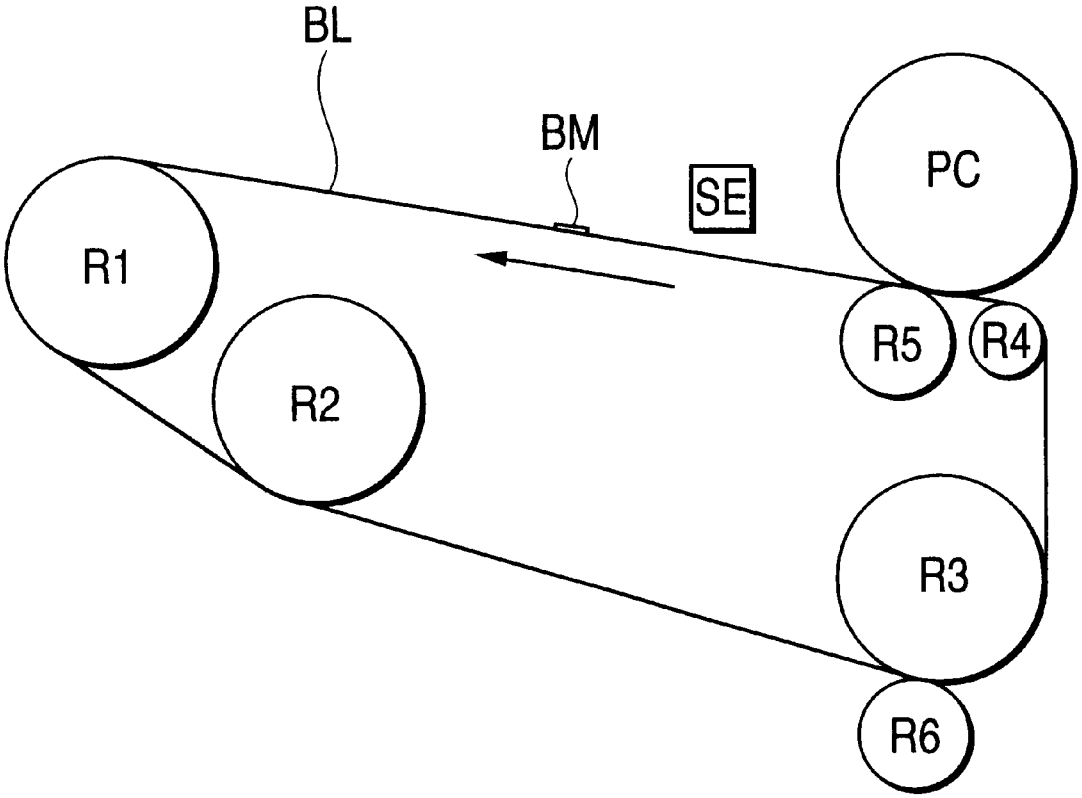
FIG. 1 is a drawing showing the outline construction of one example of the intermediate transfer unit in the image-forming apparatus of the present invention to explain the timing to stop the intermediate transfer belt of said unit.

The conditions regarding Ls delineated above are explained with reference to FIGS. 1 and 2. FIG. 1 shows an intermediate transfer belt unit. It comprises belt drive roller R1, which is driven to rotate counterclockwise in the drawing, tension roller R2, support roller R3, small-diameter backup roller R4 and first transfer roller R5, over which intermediate transfer belt BL is suspended. During the second transfer of the toner image, second transfer roller R6 is made to come into contact with the area of belt BL that is supported by support roller R3. PC is a photoreceptor. BM is a belt mark. SE is a belt mark detecting sensor.

FIGS. 2(A)–(D) are a development drawing of the intermediate transfer belt unit shown in FIG. 1. It shows the position of belt mark detecting sensor SE and the position at which belt mark BM stops in accordance with the present invention when the belt stops moving, in several possible cases. In FIG. 2, Vs, Vt, t30, L5, L7, L8, L9, L10 and L11 are as explained above. L6 is the distance on the belt between belt mark BM when the belt stops moving and backup roller R4, measured along the direction of movement of the belt toward the downstream side.

Figure 2A:
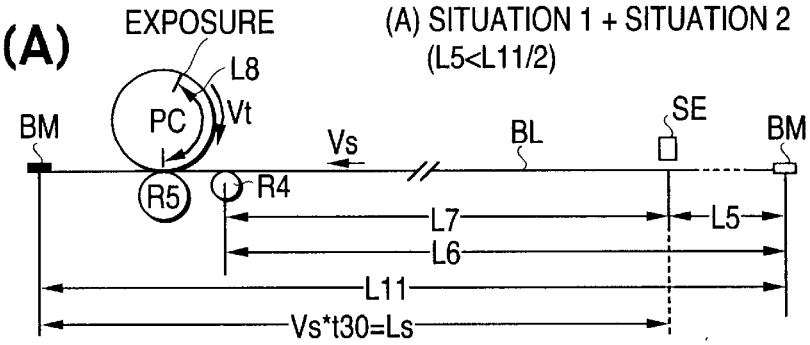
FIGS. 2(A) through 2(D) are drawings showing various positional relationships between the belt mark used to determine the timing to stop the belt and the sensor that detects said belt mark in the intermediate transfer unit shown in FIG. 1.

FIG. 2(A) shows the case of the condition L5<L11/2 (where the position of the belt mark BM when the intermediate transfer belt stops moving is near to and upstream from belt mark detecting sensor SE in terms of the direction of movement of the belt) (situation 1), where sensor SE is near to and downstream from roller R4 (situation 3).

Figure 2B:
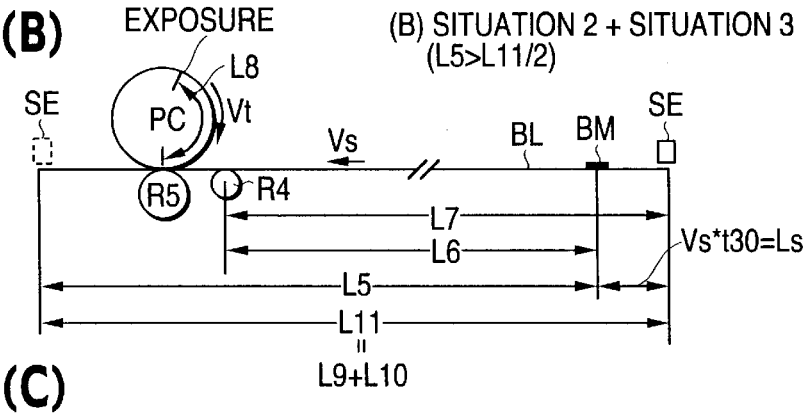

FIG. 2(B) shows the case of the condition L5>L11/2 (where the position of belt mark BM when the intermediate transfer belt stops moving is near to and downstream from belt mark detecting sensor SE in terms of the direction of movement of the belt) (situation 2), where sensor SE is near to and downstream from roller R4 (situation 3).

Figure 2C:
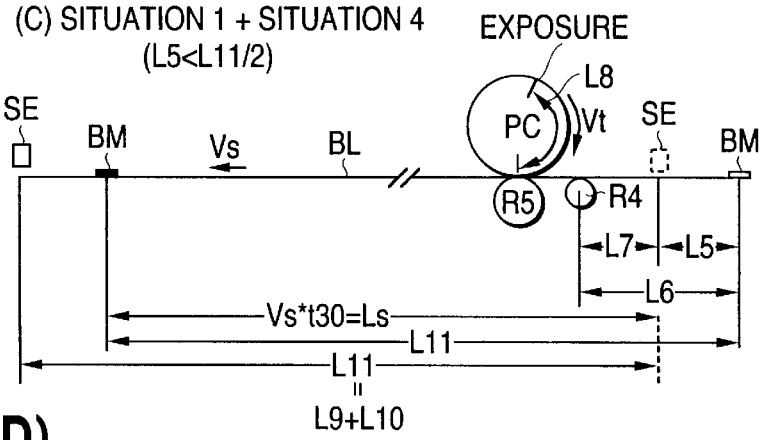

FIG. 2(C) shows the case of the condition L5<L11/2 (where the position of belt mark BM when the intermediate transfer belt stops moving is near to and upstream from belt mark detecting sensor SE) (situation 1), where sensor SE is near to and upstream from roller R4 (situation 4).

Figure 2D:
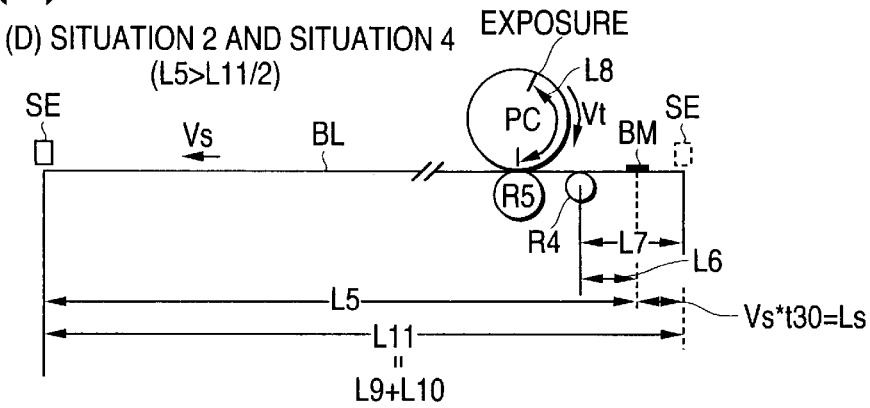

FIG. 2(D) shows the case of the condition L5>L11/2 (where the position of belt mark BM when the intermediate transfer belt stops moving is near to and downstream from belt mark detecting sensor SE) (situation 2), where sensor SE is near to and upstream from roller R4 (situation 4).

In order to achieve the object of the present invention, while the positions of sensor SE or small-diameter backup roller R4 do not affect the effectiveness of the present invention, it is necessary to meet conditions 1 and 2 shown below.

Condition 1

When belt BL begins to be driven for the next image formation and the image (toner image) is transferred to belt BL, the area of belt BL on which the leading edge of the image will be formed is located upstream from the area of belt BL that is in contact with backup roller R4 prior to the commencement of the driving of belt BL.

Condition 2

When belt BL begins to be driven for the next image formation and the image (toner image) is transferred to belt BL, the area of belt BL on which the trailing edge of the image will be formed is located downstream from the area of belt BL that is in contact with backup roller R4 prior to the commencement of the driving of belt BL.

Here, the distance that the intermediate transfer belt travels between the detection of mark BM by sensor SE and the commencement of exposure may be expressed as $Vs \times t20$. The distance that the intermediate transfer belt travels between the commencement of exposure and the arrival of the exposed photoreceptor surface at the first transfer area may be expressed as $L8 \times Vs/Vt$.

Therefore, the distance from the belt mark to the leading edge of the image formation area may be expressed as $-(Vs \times t20+L8 \times Vs/Vt)$ or $L11-(Vs \times t20+L8 \times Vs/Vt)$.

In order to meet condition 1 shown above, $L6>L11-(Vs \times t20+L8 \times Vs/Vt)$ is necessary, and in order to meet condition 2 shown above, $L11-(Vs \times t20+L8 \times Vs/Vt)+L9>L6$ is necessary.

In situation 1 shown in FIG. 2(A) and FIG. 2(C), $t30=(L11-L5)/Vs$. Therefore, $L11-Vs \times t30=L5$ results.

In situation 2 shown in FIG. 2(B) and FIG. 2(D), $t30=(L11-L5)/Vs$. Therefore, $L11-Vs \times t30=L5$ results.

With regard to the relationship among L6, L5 and L7, as shown in FIG. 2(A), $L7=L6-L5$ in situations 1 and 3. Therefore, $L5=L6-L7$ results.

In situations 2 and 3, as shown in FIG. 2(B), $L7=L6+(L11-L5)$. Therefore, $L5=L11+L6-L7$ results.

In situations 1 and 4, as shown in FIG. 2(C), $L7=L6-L5$. Therefore, $L5=L6-L7$ results.

In situations 2 and 4, as shown in FIG. 2(D), $L7=L6+(L11-L5)$. Therefore, $L5=L11+L6-L7$.

Ls ($=Vs \times t30$) shown above that meets conditions 1 and 2 when a combination of situations 1 and 3 or situations 1 and 4 is present is calculated below.

Because $L11-Vs \times t30=L5=L6-L7$, $L11-Vs \times t30+L7=L6$ and $L11-(Vs \times t20+L8 \times Vs/Vt)+L9>L11-Vs \times t30+L7=L6>L11-(Vs \times t20+L8 \times Vs/Vt)$ results.

Therefore, the equation $Ls=Vs \times t30$ must satisfy the equation $[(Vs \times t20+L8 \times Vs/Vt)-L9+L7]<Ls<[(Vs \times t20+L8 \times Vs/Vt)+L7]$ as a condition.

When seeking this Ls, because speed of movement Vs of the belt is constant in the control to stop the belt, Ls may be essentially obtained by counting time t30 that meets the condition $[(Vs \times t20+L8 \times Vs/Vt)-L9+L7]/Vs<t30<[(Vs \times t20+L8 \times Vs/Vt)+L7]/Vs$.

Ls ($=Vs \times t30$) that meets conditions 1 and 2 when a combination of situations 2 and 3 or situations 2 and 4 is present is calculated below.

Because $L11-Vs \times t30=L5=L11+L6-L7$, $L7-Vs \times t30=L6$ and $L11-(Vs \times t20+L8 \times Vs/Vt)+L9>L7-Vs \times t30=L6>L11-(Vs \times t20+L8 \times Vs/Vt)$ results.

Therefore, the equation $Ls=Vs \times t30$ must satisfy the equation $[(Vs \times t20+L8 \times Vs/Vt)-L9+L7-L11]<Ls<[(Vs \times t20+L8 \times Vs/Vt)+L7-L11]$ as a condition.

When seeking this Ls, because speed of movement Vs of the belt is constant in the control to stop the belt, Ls may be essentially obtained by counting time t30 that meets the condition $[(Vs \times t20+L8 \times Vs/Vt)-L9+L7-L11]/Vs<t30<[(Vs \times t20+L8 \times Vs/Vt)+L7-L11]/Vs$.

Embodiment

An embodiment of the present invention is explained below with reference to the drawings.

Figure 3:
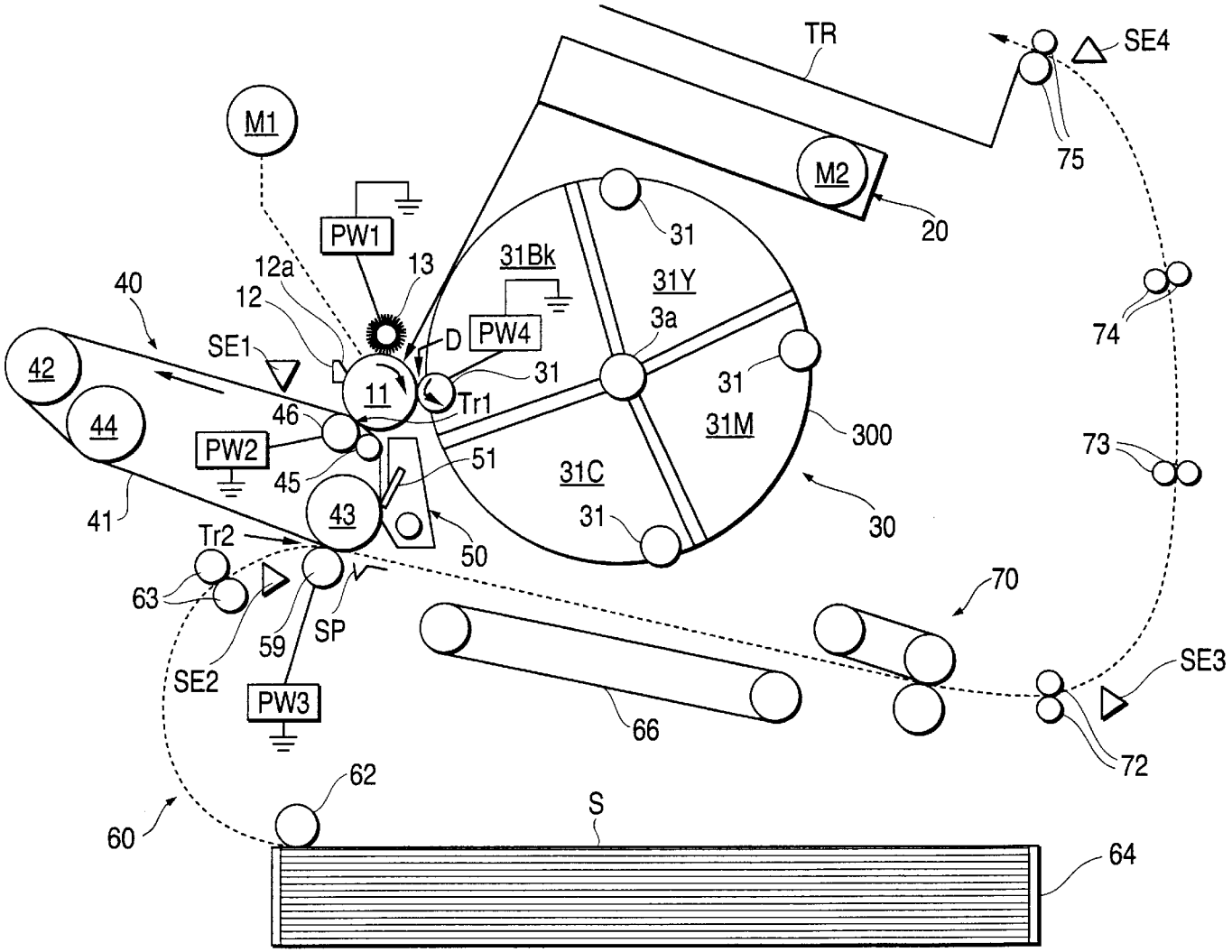
FIG. 3 is a drawing showing the outline construction of a full-color laser printer, one embodiment of the present invention.

FIG. 3 shows the outline construction of a full-color laser printer, one embodiment of the present invention.

This printer is equipped with a photoreceptor drum 11, a laser scanning optical system 20, a full-color developing device 30, an intermediate transfer unit 40 including an intermediate transfer belt 41, and a paper feeder 60.

Around the photoreceptor drum 11 are located a charger brush 13 and cleaner 12. The charger brush 13 is used to uniformly charge the surface of the photoreceptor drum 11 to a prescribed level of potential. A charging voltage may be applied to it from power supply PW1. The cleaner 12 scrapes off the residual toner on the photoreceptor drum 11 by means of the blade 12*a*.

The photoreceptor drum 11 and charger brush 13 are both driven by main motor M1 via a transmission mechanism, not shown, so that the photoreceptor drum 11 rotates clockwise and charger brush 13 rotates counterclockwise in the drawing.

The laser scanning optical system 20 is a public domain device incorporating a laser diode, polygonal mirror, fθ optical element, etc. Image data for C (cyan), M (magenta), Y (yellow) and Bk (black), respectively, is transferred from a host computer 101 (see FIG. 6) to the control unit of the laser scanning optical system 20. The polygonal mirror, not shown, of the laser scanning optical system 20 is driven to rotate by means of polygonal mirror motor M2. The laser scanning optical system 20 sequentially outputs image data for each color as laser beams, and can scan and expose the surface of photoreceptor drum 11. This sequentially forms electrostatic latent images of each color on the photoreceptor drum 11.

The full-color developing device 30 comprises four developer units for each color, i.e., 31C, 31M, 31Y and 31Bk, that contain a developing agent including cyan, magenta, yellow and black toner, respectively, and that is attached to a developing rack 300. The developing rack 300 may be rotated clockwise in the drawing at prescribed times by means of a dedicated motor, not shown, with a shaft 3*a* operating as the fulcrum. The developer units are switched from one to another each time that an electrostatic latent image of one color is formed on the photoreceptor drum 11, such that a developing sleeve 31 of the corresponding developer unit may be positioned at developing position D. By employing the rotary full color developing device 30, described above, the entire printer is more compact. When it is positioned at developing position D, the developing sleeve 31 of the developer unit of each color may be driven to rotate counterclockwise, in the drawing, by means of main motor M1 referred to above and via a transmission mechanism, not shown, and a developing bias may be applied to it from power supply PW4. The intermediate transfer belt 41 of the intermediate transfer unit 40 is suspended over a belt drive roller 42, support roller 43, tension roller 44, small-diameter backup roller 45 and first transfer roller 46, such that it wraps around them in a continuous loop. A first transfer bias may be applied from power supply PW2 to the first transfer roller 46. The first transfer roller 46 is rotatable and puts belt 41 into contact with the photoreceptor drum 11 at all times. This contact area constitutes first transfer area Tr1. The backup roller 45 presses belt 41 against the photoreceptor drum 11 to first assist the transfer roller 46. The area of the belt between this backup roller 45 and first transfer roller 46, the area that is suspended over backup roller 45, in particular, is susceptible to creep buckling when the belt stops moving (and is termed the 'creep buckling risk area'). A control means is performed such that this area will not pass first transfer area Tr1 during the first transfer, as described below. The belt drive roller 42 is driven to rotate counterclockwise in the drawing by means of main motor M1 and via a transmission mechanism, not shown.

Figure 4A:
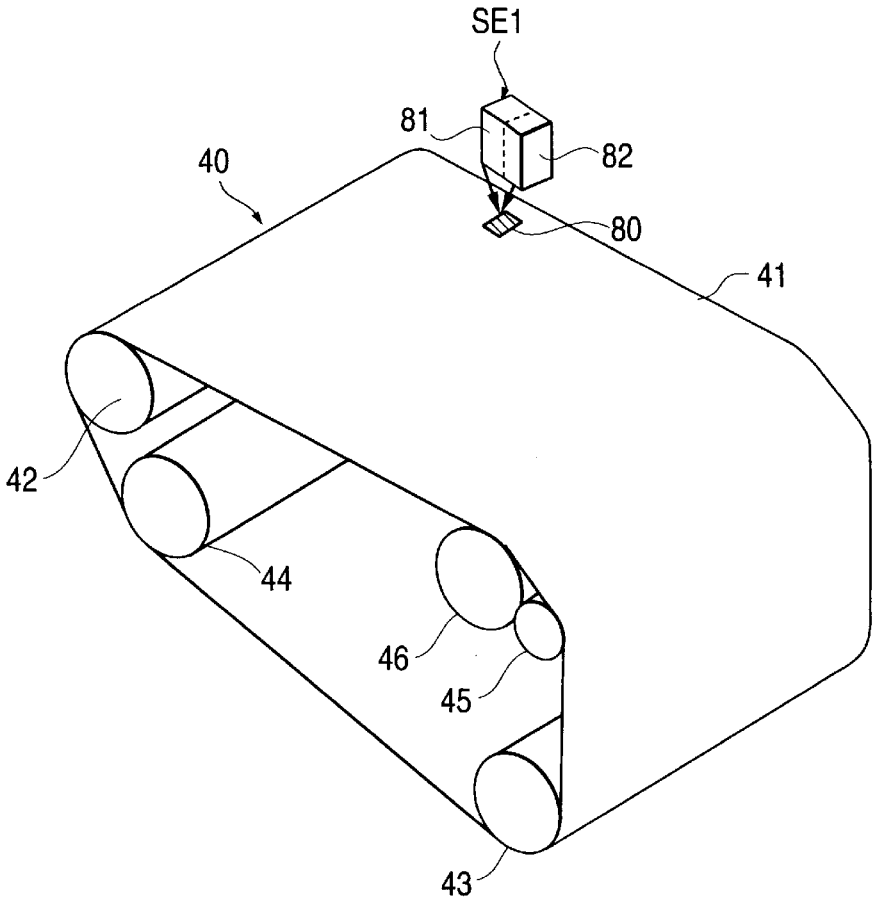
FIG. 4(A) is a simplified perspective view showing the intermediate transfer unit in the printer shown in FIG. 3, including the belt mark and the sensor to detect it.

As best shown in FIG. 4(A), belt mark 80, indicating a prescribed point on the belt, is formed on an area of belt 41 that does not affect image formation during the first transfer (on a side edge of the belt in this embodiment). This belt mark 80 may be detected by reflection–based belt mark detecting sensor SE1. The detection of mark 80 by belt mark detecting sensor SE1 is used for the timing control of the exposure of image data onto the photoreceptor drum 11, as well as for the timing control of belt stoppage, as described below.

Belt mark 80 is formed using a material that has a higher reflectance than the intermediate transfer belt 41 (aluminum, for example). As shown in FIG. 4(A), belt mark detecting sensor SE1 is equipped with a light emission unit 81, including a light–emitting diode and resistor element and light receiving unit 82 having a phototransistor and resistor element. When a voltage is provided from a power supply, a drive current flows to the light-emission unit 81 and a circular beam of light is projected from the light-emission unit 81 onto the intermediate transfer belt 41. When its reflected light enters the light receiving unit 82, a current with a strength corresponding to the intensity of the reflected light flows to light receiving unit 82. The belt mark 80 may be detected by comparing this current that flows to the light receiving unit 82 and a prescribed threshold current.

In this embodiment, the threshold current is set to be 0.16 mA. The distance between sensor SE1 and belt 41 is set to be 2.5 mm. Using this construction, accurate mark detection is possible even if the distance between sensor SE1 and belt 41 fluctuates by approximately 1.5 mm.

Incidentally, if belt 41 is used over a long period of time, it becomes elongated, but this elongation is absorbed by the tension roller 44, and consequently, belt 41 expands outward. In this example, the change in the position of belt 41 in the vicinity of the tension roller 44 at approximately 3 mm. As described above, since the allowable amount of change in distance between sensor SE1 and belt 41 is approximately 1.5mm, if sensor SE1 were placed near the tension roller 44, it would become unable to detect belt mark BM after long use. Further, since the tension roller 44 is given force by a spring, not shown, the vibration of belt 41 in its vicinity is relatively large and this vibration easily would cause missed detection. Therefore, it is necessary to locate sensor SE1 at a position where there is little vibration.

The position of belt mark detecting sensor SE1 and the position of the belt mark 80 when belt 41 stops moving are explained below.

Figure 4B:
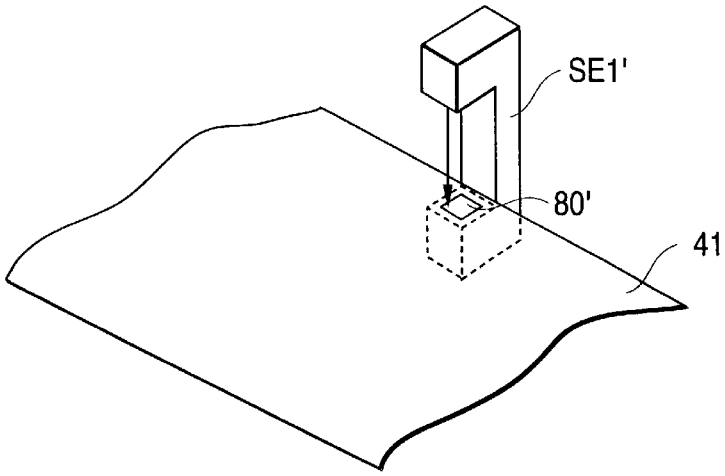
FIG. 4(B) is a perspective view showing another example of a belt mark and detecting sensor regarding the same intermediate transfer unit.

As shown in FIG. 4(B), for the belt mark 80, a small hole 80' may be formed along a side edge of belt 41, as long as this does not affect the strength of the belt, so that the small hole 80' may be detected by sensor SE1' that works based on light that passes through said hole.

As best shown in FIG. 3, a second transfer roller 59 is located next to the intermediate transfer unit 40 described above. In other words, the rotatable second transfer roller 59 is located such that it may be put into contact with the area of the intermediate transfer belt 41 that is supported by the support roller 43. A cleaner 50 is located between the second transfer roller 59 and backup roller 45 such that the cleaning blade 51 of this cleaner may come into contact with belt 41 and remove the residual toner on the belt 41 after the second transfer. A second transfer bias may be applied to the second transfer roller 59 from power supply PW3. The second transfer roller 59 and cleaning blade 51 are made to come into contact with belt 41 by means of a cam mechanism, not shown, when the overlapping toner images formed on belt 41 are transferred to a recording medium (in the second transfer), and are made to come apart from belt 41 when second transfer is completed. The area in which the second transfer roller 59 comes into contact with belt 41 constitutes second transfer area Tr2.

The paper feeder 60, referred to above, includes a detachable feeder cassette 64, feeder roller 62 to pull out recording media S (recording paper in this embodiment) one by one from the feeder cassette 64, and pair of timing rollers 63 that send the recording paper thus pulled out to the second transfer area Tr2 in synchronization with the toner images on the intermediate transfer belt 41.

Downstream from the second transfer roller 59, in terms of the direction of conveyance of the recording paper, are located: a separating device SP that separates the recording paper on which the toner images have been transferred during a second transfer from the belt 41 (separating device SP comprising a discharger needle), a recording paper conveyance belt device 66, a fusing device 70 that fuses the toner images onto the recording paper, a plurality of conveyance roller pairs 72, 73 and 74 that convey the recording paper after fusing, a pair of recording paper ejection rollers 75 and a recording paper ejection tray TR. The paper feeder 60 and these conveyance systems are also driven by main motor M1 and via a transmission mechanism, not shown.

Multiple recording paper detecting sensors SE2, SE3 and SE4 are located in the recording paper conveyance path in order to detect the existence of recording paper S. Recording paper detecting sensors SE2, SE3 and SE4, output detection signals when detecting the first edge or the rear edge of recording paper S in terms of the direction of conveyance. The occurrence of a paper jam involving recording media S and the location of the jam are detected based on detection signals from recording paper detecting sensors SE2, SE3 and SE4, and the differences in time when they are received. It is also detected when ejection of recording paper S is completed based on detection signals from recording paper detecting sensor SE4.

In order to remove recording paper S that is jammed, the printer main unit is equipped with a cover, not shown, that may be opened and closed.

The relationship between the position of belt mark detecting sensor SE1 of the intermediate transfer unit 40 and the position of the belt mark 80 when belt 41 stops moving will now be explained with reference to FIG. 5.

Figure 5:
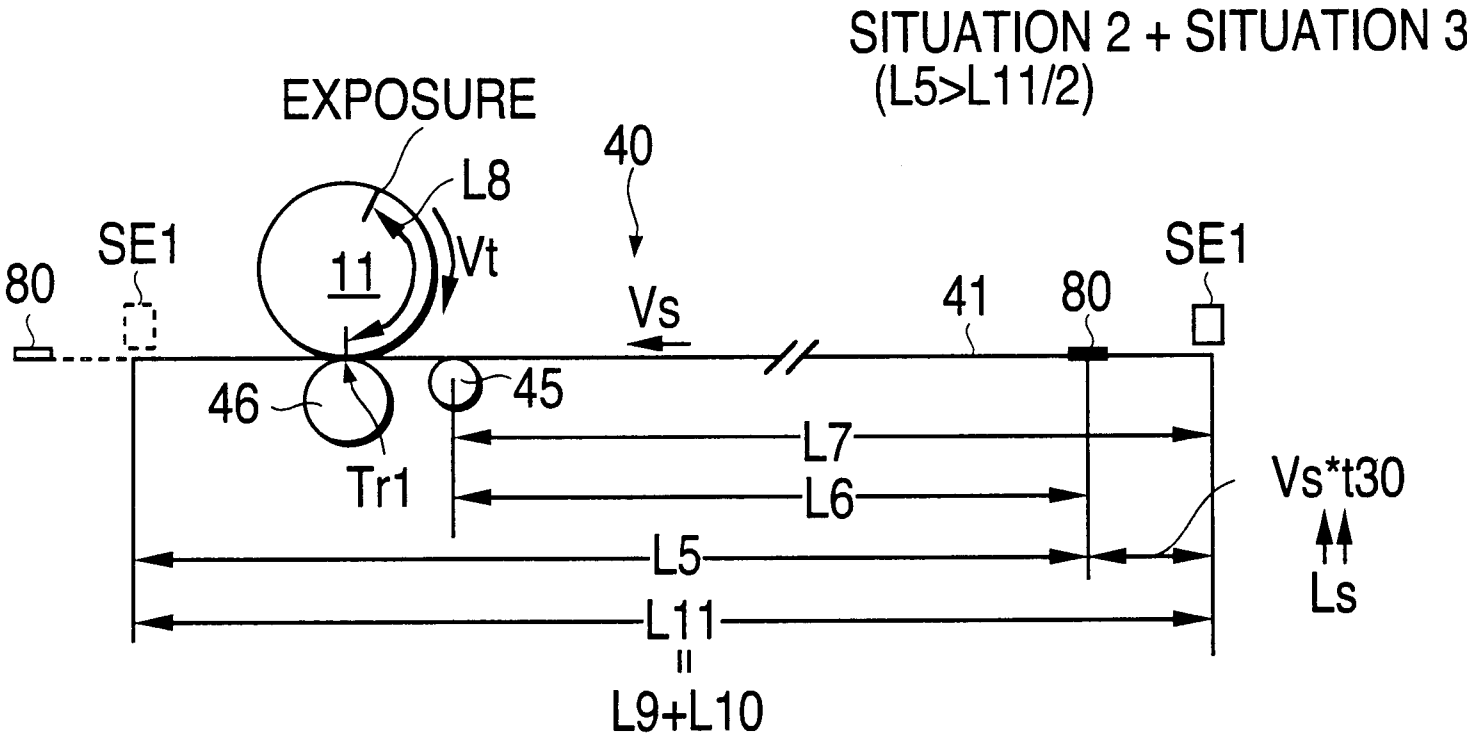
FIG. 5 is a drawing showing the positional relationships among the belt mark to determine the timing to stop the belt of the intermediate transfer unit in the printer shown in FIG. 3, the sensor to detect the belt mark, and a small-diameter backup roller.

In this intermediate transfer unit 40, as shown in FIG. 5, the position of belt mark 80 when belt 41 stops moving is near to and downstream from belt mark detecting sensor SE1 in terms of the direction of movement of the belt, which corresponds to the situation shown in FIG. 2(B).

When belt 41 has traveled distance Ls that meets the following condition after sensor SE1 detects belt mark 80, or in other words, after time t30 that meets the following condition has passed after the detection of belt mark 80 by sensor SE1, belt 41 is stopped.

$$[(Vs\times t20+L8\times Vs/Vt)-L9+L7-L11]<Ls=Vs\times t30<[(Vs\times t20+L8\times Vs/Vt)+L7-L11]$$

where,

Vs: speed of movement of belt 41 (constant speed)

Vt: speed of movement of the photoreceptor surface t20: time between the detection of mark 80 by sensor SE1 and the commencement of exposure of photoreceptor drum 11

L5: distance on the belt between mark 80 and sensor SE1 when the belt stops moving, measured along the direction of movement of the belt toward the downstream side L6: distance on the belt between mark 80 and backup roller 45 when the belt stops moving, measured along the direction of movement of the belt.

L7: distance on the belt between sensor SE1 and backup roller 45, measured along the direction of movement of the belt toward the downstream side L8: distance on photoreceptor drum 11 between its exposure position and first transfer area Tr1

L9: length of the non–image formation area on belt 41, measured along the direction of movement of the belt L10: length of the image formation area of belt 41 along the direction of movement of the belt L11: entire length of the intermediate transfer belt (L9+L10)

In this example, Vs is a system velocity that is equal to Vt.

The outline of the printing operation of this printer will be explained hereafter.

At the beginning of the printing operation, the second transfer roller 59 and blade 51 are separated from intermediate transfer belt 41. When the printing operation starts, main motor M1 is activated and the photoreceptor drum 11 is charged up to a prescribed level of potential by means of the charger brush 13 to which a charging voltage is applied from power supply PW1. The developing rack 300 is turned such that cyan developer unit 31C will be positioned at developing position D, whereupon the developing sleeve 31 is driven to rotate and a developing bias is applied to the developing sleeve from power supply PW4.

Exposure regarding the cyan image is then carried out by means of the laser scanning optical system 20, and an electrostatic latent image of the cyan image is formed on the photoreceptor drum 11. This electrostatic latent image is immediately developed by means of the developer unit 31C, and then is transferred onto intermediate transfer belt 41 in first transfer area Tr1 by means of the first transfer roller 46 to which a first transfer bias is applied from power supply PW2. Following the completion of the first transfer of the cyan toner image, developer unit 31M is switched to developing position D, whereupon exposure, development and first transfer regarding the magenta image are carried out. In the same manner, switching to developer unit 31Y and exposure, development and first transfer regarding the yellow image takes place. Subsequently, switching to developing unit 31Bk and exposure, development and first transfer regarding the black image is performed. Each time a first transfer takes place, a toner image is laid over the previous toner image or images on intermediate transfer belt 41.

When the first set of first transfers is completed, the developer unit 31C of the developing device 30 is switched back to developing position D for the next printing process, and at the same time, the second transfer roller 59 and blade 51 are pressed against the intermediate transfer belt 41. A second transfer bias is applied to the second transfer roller 59 from power supply PW3. Recording paper S is then sent to second transfer area Tr2, whereupon the overlapping toner images formed on the intermediate transfer belt 41 are transferred onto recording paper S. When this second transfer is completed, the second transfer roller 59 and blade 51 are separated from the intermediate transfer belt 41.

Recording paper S onto which the overlapping toner images have been transferred is separated from belt 41 by means of separating device SP and is carried to the fusing device 70 by means of the conveyance belt 66, whereupon it undergoes fusing. After the fusing, recording paper S is ejected onto ejection tray TR by means of the conveyance roller pairs 72, 73 and 74, and pair of ejection rollers 75.

Figure 6:
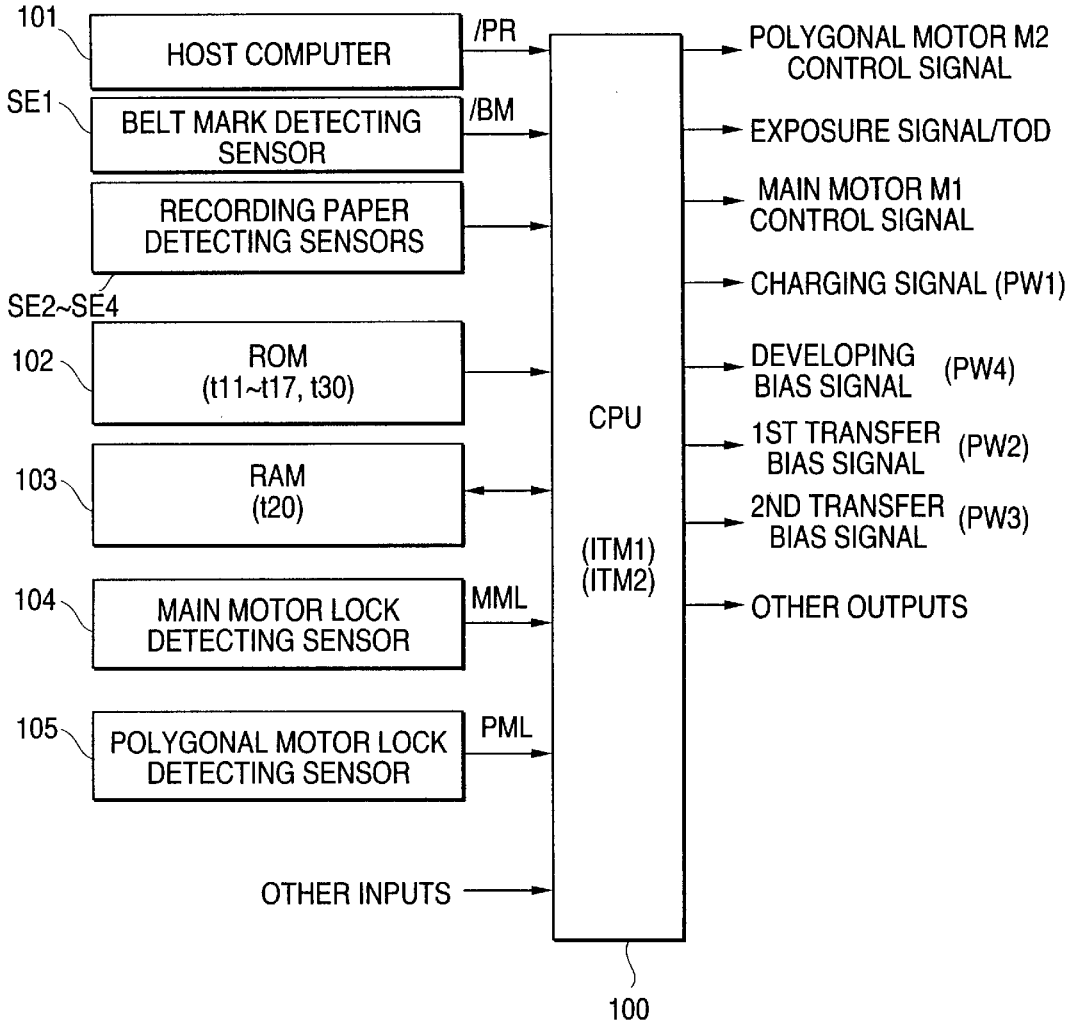
FIG. 6 is a block diagram showing the outline of the control circuit of the printer shown in FIG. 3.

The control processes for printing and to stopping the transfer belt 41 of the intermediate transfer unit 40 will now be explained. FIG. 6 is a block diagram showing the outline of the printer control circuit. This printer, as shown in FIG. 6, has central processing unit (CPU) 100 that controls the printing operation. Connected to this CPU 100 are belt mark detecting sensor SE1 and recording paper detecting sensors SE2 through SE4, which are shown in FIGS. 3 and 5, host computer 101, read-only memory (ROM) 102, random access memory (RAM) 103, main motor lock detecting sensor 104 and polygonal motor lock detecting sensor 105. Host computer 101 outputs print signals /PR and image data for each pixel of the original to the CPU 100. In the ROM 102 are stored as timer values time t11 from the turning ON of polygonal motor M2 to the turning ON of main motor M1, time t12 from the turning ON of main motor M1 to the commencement of charging and exposure, exposure time t13, time t14 from the completion of exposure to the commencement of development, time t15 from the commencement of development to the commencement of first transfer, time t16 from the completion of exposure to the commencement of paper feeding, time t17 from the commencement of paper feeding and the turning ON of second transfer bias to the turning OFF of second transfer bias, and time t30 from the detection of belt mark 80 by sensor SE1 to the stoppage of belt 41, the time meeting the condition shown above. The CPU 100 counts these timer values and controls the printer based on the counted values. In other words, the CPU 100 and ROM 102 comprise timers TM (t11) through TM (t17) and TM (t30) in which times t11 through t17 and t30 are set, respectively.

The CPU 100 also includes two interrupt timers ITM1 and ITM2. Interrupt timer ITM1 counts time t20 between the detection of belt mark 80 by sensor SE1 and the commencement of exposure. Time t20, counted by interrupt timer ITM1, is stored in the RAM 103 as a timer value. The timer value read from the RAM 103 is set in interrupt timer ITM2.

The main motor lock detecting sensor 104 detects that the driving of main motor M1 has stabilized and outputs main motor lock detection signal MML to the CPU 100. The polygonal motor lock detecting sensor 105 detects that the driving of polygonal motor M2 has stabilized and outputs polygonal motor lock detection signal PML to CPU 100.

On the other hand, the CPU 100 outputs polygonal motor M2 control signals to drive or stop polygonal motor M2, exposure signals /TOD (imaging instruction signals) to perform exposure of photoreceptor drum 11, main motor M1 control signals to drive or stop main motor M1, charging signals to instruct charging power supply PW1 and charge photoreceptor drum 11, developing bias signals to instruct developing bias power supply PW4 and perform application of a developing bias voltage, first transfer bias signals to instruct first transfer power supply PW2 and perform application of a first transfer bias voltage, and second transfer bias signals to instruct second transfer power supply PW3 and perform application of a second transfer bias voltage. The printer is controlled based on these signals.

Figure 7:
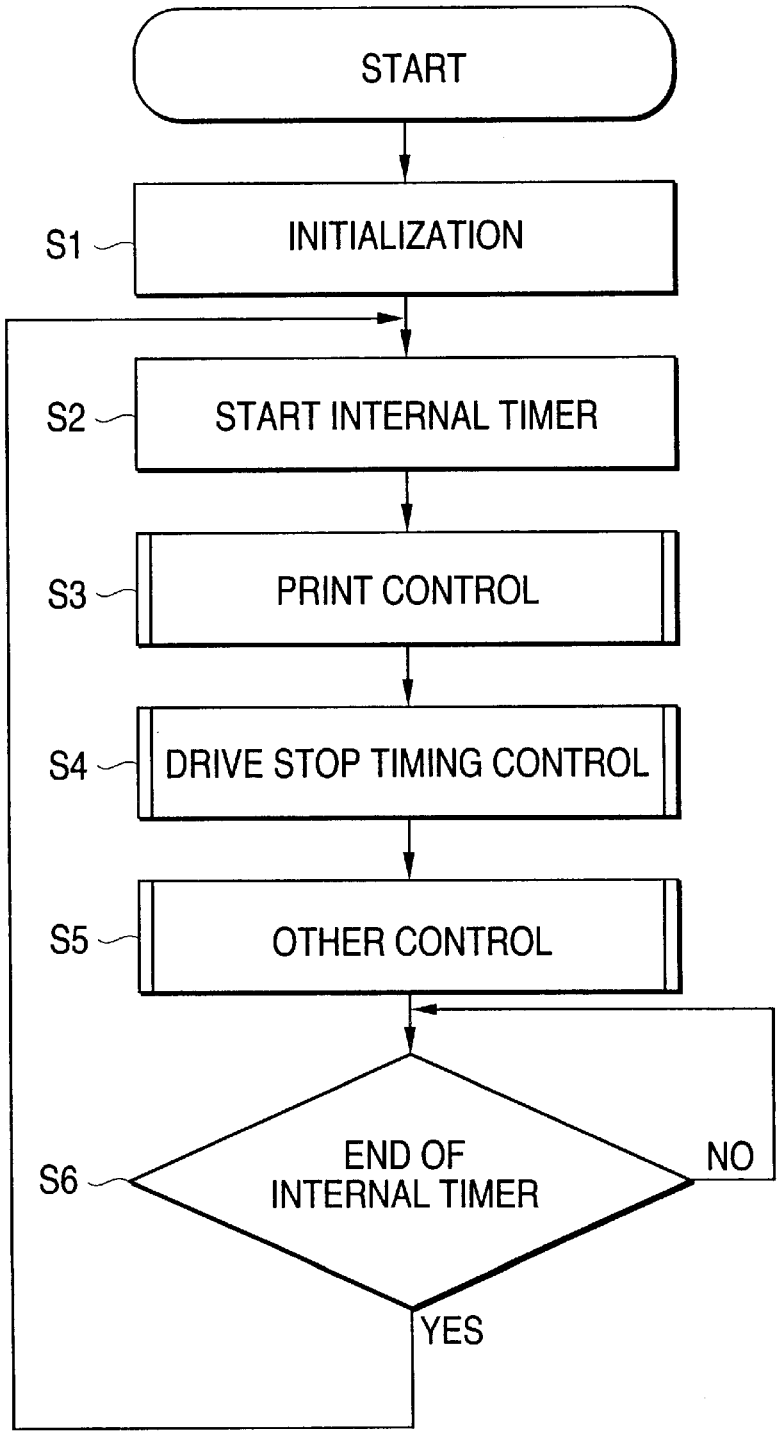
FIG. 7 is a main flowchart showing the operation of the CPU in the control circuit shown in FIG. 6.
Figure 8:
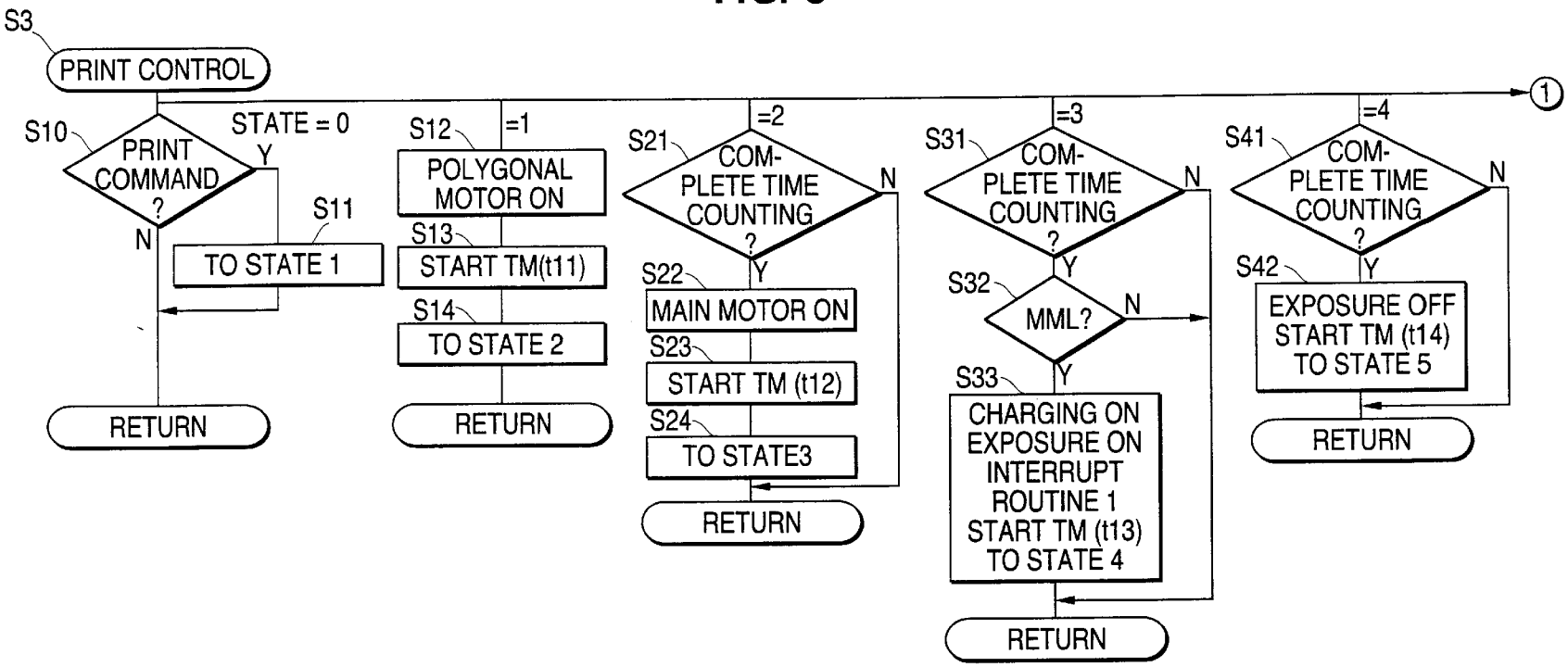
FIG. 8 is a flowchart showing part of the printing control routine shown in FIG. 7.

FIG. 7 is a main flowchart showing the operation of the CPU 100. When power to the printer is turned ON, the CPU initialization process takes place in step S1 in which various flags and timers are initialized. An internal timer is started in step S2. Printing control takes place in step S3, and drive stop timing control to stop the driving of the belt such that the belt mark 80 will be stopped at a prescribed position is performed in step S4. After performing other control procedures in step S5, such as those for paper feeding and ejection and for error handling, and standby in step S6, CPU 100 returns to step S2, in which the processes described above are repeated.

FIGS. 8 through 12 are flowcharts showing the printing control of step S3 in the flowchart shown in FIG. 7. FIG. 13 is a flowchart showing the intermediate transfer belt drive stop timing control of step S4 shown in the flowchart of FIG. 7.

The printing control performed by CPU 100 is explained with reference to FIGS. 8 through 12. First, in FIG. 8, it is determined in step S10 of state 0 whether or not a print command (input of a print signal /PR) has been received from host computer 101. If a print command has been received, CPU 100 advances to state 1 in step S11.

CPU 100 drives polygonal motor M2 in step S12 of state 1. It then starts timer TM (t11) in step S13 and advances to state 2 in step S14.

CPU 100 then waits for timer TM (t11) to complete time counting in step S21 of state 2. When the time counting by timer TM (t11) is completed, CPU 100 starts main motor M1 in step S22 and timer TM (t12) in step S23, and advances to state 3 in step S24.

CPU 100 then waits for timer TM (t12) to complete time counting in step S31 of state 3 and for the input of main motor lock detection signal MML in step S32. This time t12 is set to be essentially equal to time t11 mentioned above. When time counting by timer TM (t12) is completed and main motor lock signal MML has been input, CPU 100 turns ON power supply PW1 in step S33 to start charging of photoreceptor drum 11 by means of charger brush 13. It also instructs laser scanning optical system 20 to start exposure and carries out interrupt routine 1.

Figure 11:
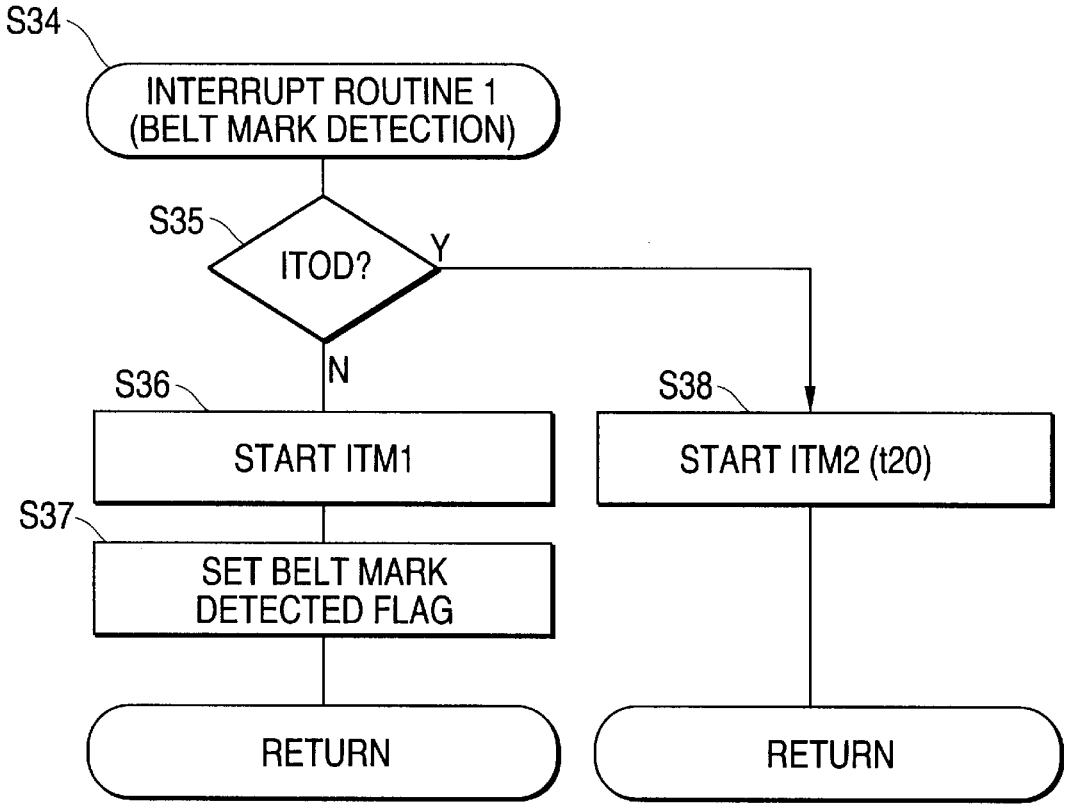
FIG. 11 is a flowchart showing an interrupt routine in the printing control routine shown in FIG. 7.

Interrupt routine 1, as shown in FIG. 11, is begun based on the detection of belt mark 80 by sensor SE1. In other words, when belt mark 80 is detected and belt mark detection signal /BM is input in step S34, CPU 100 determines in step S35 whether or not an exposure signal /TOD for the first color has been output. Where it is determined in step S35 that an exposure signal /TOD has not been output, CPU 100 starts interrupt timer ITM1 in step S36 and sets a belt mark detected flag in step S37.

Where it is determined in step S35 that an exposure signal /TOD has been output, CPU 100 starts interrupt timer ITM2 (t20) in step S38. When time counting by interrupt timer ITM2 (t20) is completed in step S39 of interrupt routine 2 shown in FIG. 12, CPU 100 outputs exposure signals /TOD in step S40.

To return to FIG. 8, CPU 100 starts timer TM (t13) in step S33 of state 3 and advances to state 4.

CPU 100 then waits for timer TM (t13) to complete time counting in step S41 of state 4. When the time counting by timer TM (t13) is completed, exposure is turned OFF in step S42. After starting timer TM (t14), CPU 100 advances to state 5 shown in FIG. 9.

Figure 9:
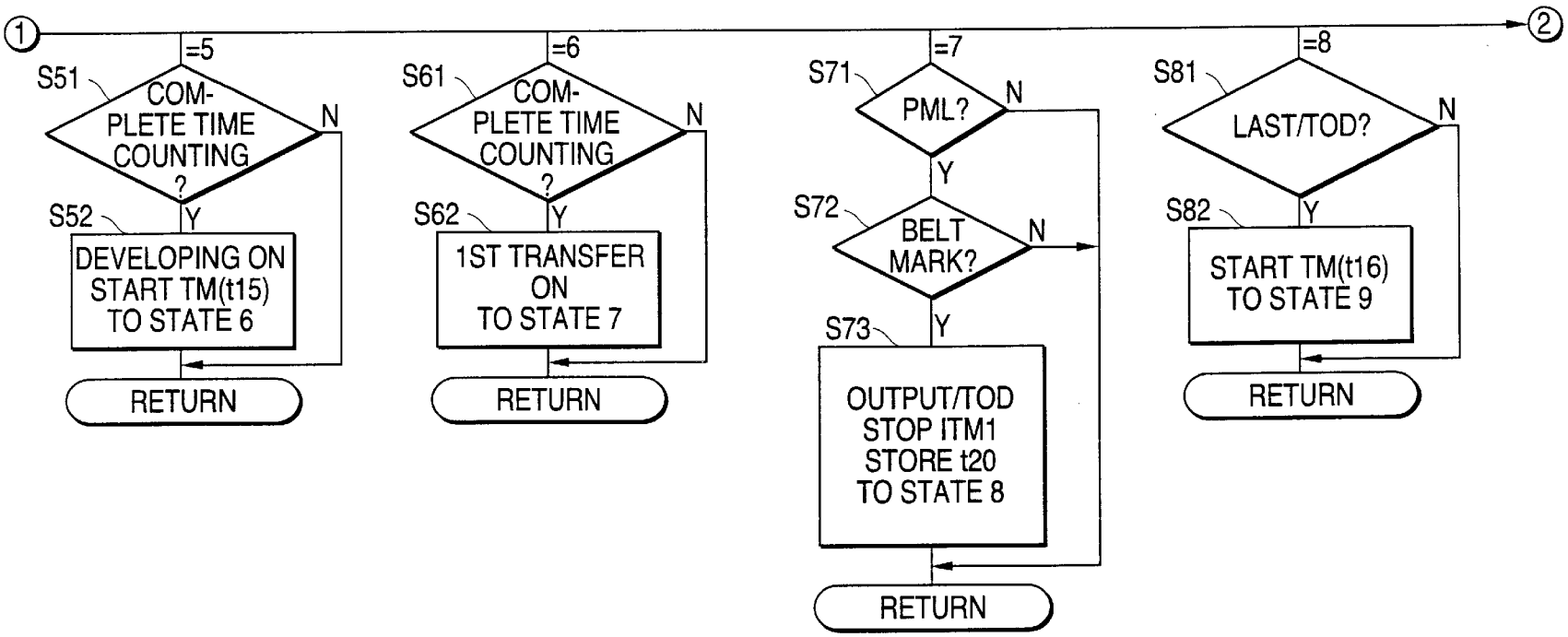
FIG. 9 is a flowchart showing another part of the printing control routine shown in FIG. 7.

In FIG. 9, CPU 100 waits for timer TM (t14) to complete time counting in step S51 of state 5. When the time counting by timer TM (t14) is completed, it turns ON power supply PW4 in step S52 to start application of a developing bias to developing sleeve 31. After starting timer TM (t15), CPU 100 advances to state 6.

CPU 100 then waits for timer TM (t15) to complete time counting in step S61 of state 6. When the time counting by timer TM (t15) is completed, CPU 100 turns ON power supply PW2 in step S62 to start application of a first transfer voltage to first transfer roller 59, and then advances to state 7.

CPU 100 waits for the input of polygonal motor lock detection signal PML in step S71 of state 7. When signal PML is input, it determines in step S72 whether or not belt mark 80 has already been detected. Where it is determined that it has already been detected, CPU 100 advances to step S73, in which it outputs an exposure signal /TOD for the first color. After stopping interrupt timer ITM1 and storing time t20 counted by the interrupt timer as a timer value in RAM 103, CPU 100 advances to state 8.

CPU 100 then determines in step S81 of state 8 whether or not signal /TOD for the last color for the last page has been output. Where it is determined that it has been output, CPU 100 advances to step S82, where it starts timer TM (t16). It then advances to state 9 shown in FIG. 10.

Figure 10:
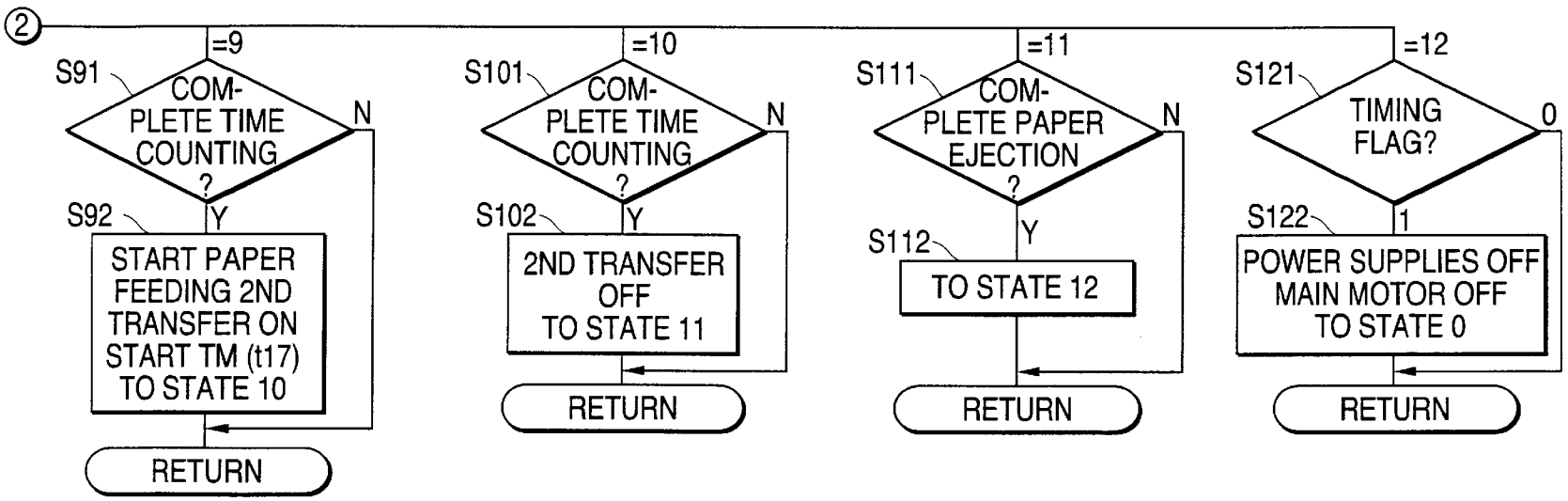
FIG. 10 is a flowchart showing yet another part of the printing control routine shown in FIG. 7.

In FIG. 10, CPU 100 waits for timer TM (t16) to complete time counting in step S91 of state 9. When the time counting by timer TM (t16) is completed, CPU 100 starts the paper feeding operation in step S92, puts second transfer roller 59 and cleaning blade 51 into contact with belt 41, and turns ON power supply PW3 to start application of a second transfer voltage to second transfer roller 59. It then starts timer TM (t17), and advances to state 10.

Figure 12:
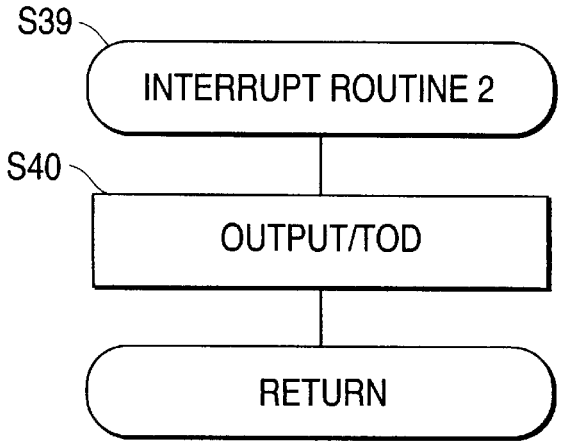
FIG. 12 is a flowchart showing another interrupt routine in the printing control routine shown in FIG. 7.
Figure 13:
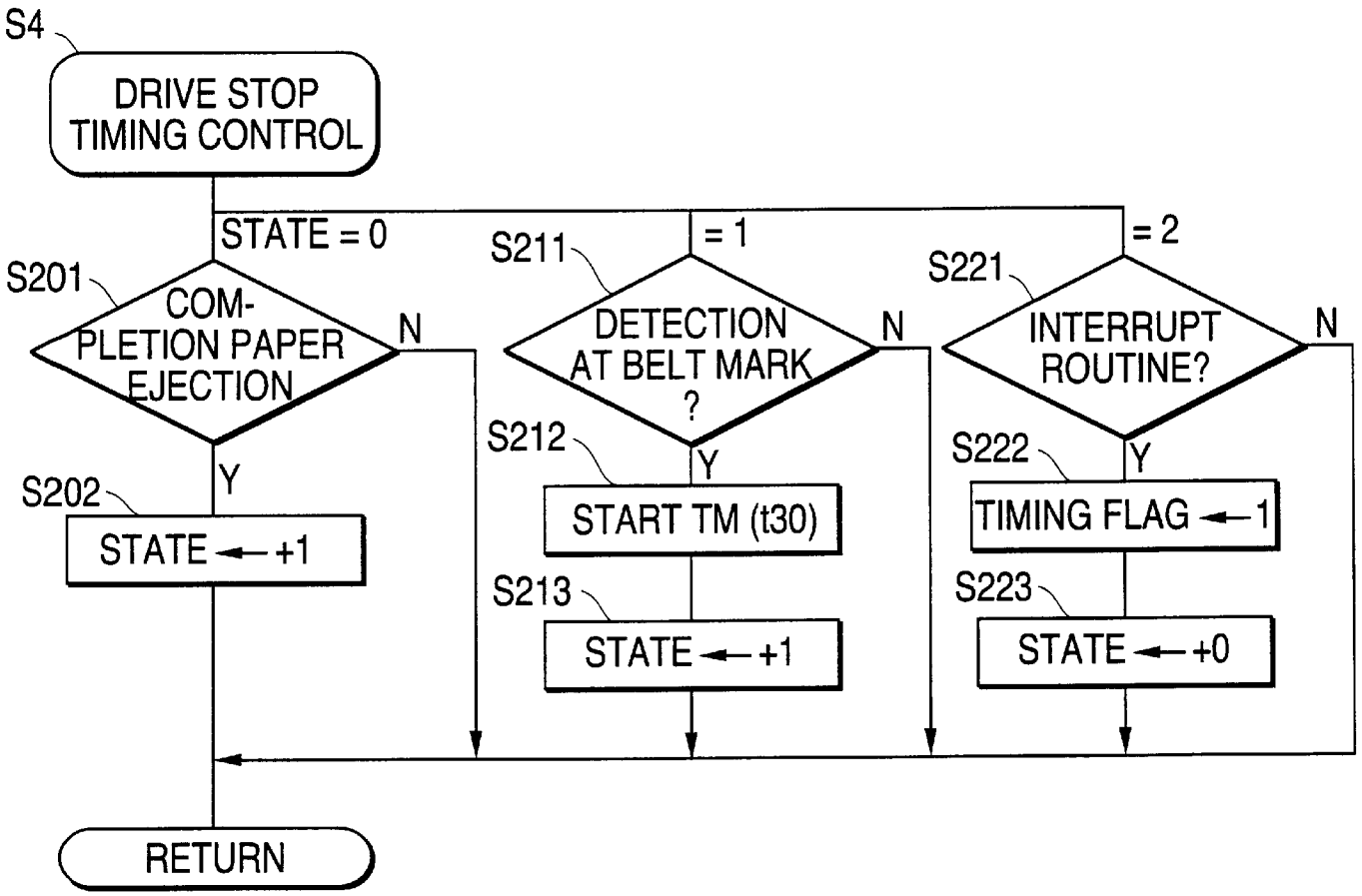
FIG. 13 is a flowchart showing the intermediate transfer belt drive stop timing control routine in the intermediate transfer unit shown in FIG. 7.

With regard to exposure signals /TOD for the second color onward, as shown in FIGS. 11 and 12, CPU 100 starts interrupt timer ITM2 (t20) when sensor SE1 has detected belt mark 80, and outputs the signal when the time counting by said interrupt timer is completed.

CPU 100 waits for timer TM (t17) to complete time counting in step S101 of state 10. When the time counting by timer TM (t17) is completed, CPU 100 separates second transfer roller 59 and cleaning blade 51 from belt 41, completing the second transfer, in step S102, and advances to state 11. The application of the second transfer voltage stops prior to this separation.

CPU 100 then waits for the completion of paper ejection in step S111 of state 11, and advances to state 12, in step S112, when paper ejection is completed. The completion of paper ejection is detected by sensor SE4.

CPU 100 then waits for the drive stop timing flag to be set in step S121 of state 12. When the drive stop timing flag is set, in step S122, it turns OFF the power supplies for charging, development and transfer (PW1 through PW4), as well as main motor M1, after which CPU 100 returns to state 0.

The drive stop timing control to stop intermediate transfer belt 41 is explained below with reference to FIG. 13. This is a control procedure to stop the intermediate transfer belt 41 in preparation for the next image formation such that the creep buckling risk area will not pass first transfer area Tr1 during the first transfer, in order to avoid the possibility that, if the creep buckling risk area of the intermediate transfer belt 41 passes first transfer area Tr1 during the first transfer, the toner image will not properly transfer from the photoreceptor drum 11 onto the belt 41 due to creep buckling or to a change in the electric resistance of the area that is subject to creep buckling. Specifically, as described above, it is a control procedure to stop belt 41 when belt 41 has traveled distance Ls (=Vs×t30) referred to above after belt mark 80 is detected by belt mark detecting sensor SE1, or in other words, when time t30 has elapsed after the detection of belt mark 80 by sensor SE1.

In this drive stop timing control, CPU 100 waits for the completion of paper ejection in step S201 of state 0 in FIG. 13, and advances to state 1, in step S202, after the completion of paper ejection.

CPU 100 then determines in step S211 of state 1 whether or not sensor SE1 has detected belt mark 80. Where belt mark 80 has been detected, CPU 100 starts timer TM (t30), in step S212, and advances to state 2 in step S213.

CPU 100 then waits for timer TM (t30) to complete time counting in step S221 of state 2. When the time counting by timer TM (t30) is completed, CPU 100 sets the drive stop timing flag in step S222, and returns to state 0 in step S223. When the drive stop timing flag is set, main motor M1 is turned OFF in step S122 shown in FIG. 10, whereupon belt 41 stops moving.

In this way, the creep buckling risk area is prevented from passing through first transfer area Tr1 during the first transfer.

In the printer explained above, the position of belt mark detecting sensor SE1 and the position of the belt mark 80 when the belt stops moving correspond to the locations shown in FIG. 2(B). However, the positional relationship between them may be set to any of the situations shown in FIG. 2(A), FIG. 2(C) or FIG. 2(D). By meeting the condition for Ls or t30 in that situation, the creep buckling risk area may be prevented from passing through first transfer area Tr1 during the first transfer.

The above explanation has been provided with regard to a printer, but the present invention may be applied to other apparatuses such as multiple color copying machines that have an intermediate transfer belt.

The present invention described above provides a number of significant advantages. As explained above, the present invention provides an image–forming apparatus, and a method thereof, that transfers the toner image formed on the photoreceptor to an intermediate transfer belt in a first transfer area during a first transfer. When the first transfers of prescribed toner images to the intermediate transfer belt are completed, the intermediate transfer belt transfers the toner images obtained in the first transfers from the intermediate transfer belt to a recording medium in a second transfer area during a second transfer. Moreover, the area of the intermediate transfer belt that is susceptible to creep buckling (the 'creep buckling risk area') is prevented from passing through the first transfer area during the first transfer, thereby improving the image formation.

The present invention provides the advantage of avoiding a defective transfer of a toner image. The present invention avoids the transfer of a toner image on the intermediate transfer belt that is suspended over a small-diameter roller. Otherwise, a defective transfer may easily occur due to the deformation or to the fluctuation in the electrical resistance caused by the deformation, causing the image finally obtained on the recording medium to also turn out defective.

Of course, it should be understood that a wide range of changes and modifications can be made to the preferred embodiment described above. It is therefore intended that the foregoing detailed description be understood that it is the following claims, including all equivalent, which are intended to define the scope of this invention.

We claim:

1. An intermediate transfer device for transferring toner images for image-forming apparatuses comprising:

a continuous intermediate transfer belt which travels along a closed path wound around rollers;

a continuous photoreceptor having toner images formed thereon, being driven to rotate by a power means, said continuous photoreceptor facing said intermediate transfer belt in a first transfer area;

a first transfer device which is located in said first transfer area, said first transfer device transferring the toner images on said continuous photoreceptor onto said intermediate transfer belt;

a belt mark disposed on said intermediate transfer belt indicating a prescribed point on said intermediate transfer belt;

a belt mark detecting sensor for detecting said belt mark; and a control means for stopping said intermediate transfer belt when said intermediate transfer belt has traveled a prescribed distance Ls after the detection of said belt mark by said belt mark detecting sensor, wherein said prescribed distance Ls is set such that an area on said intermediate transfer belt susceptible for incurring creep buckling is prevented from passing the first transfer area while said first transfer device transfers the toner images onto said intermediate transfer belt.

2. The intermediate transfer device according to claim 1, further comprising:

a backup roller being located adjacent to and upstream from said first transfer area in terms of the direction of movement of the intermediate transfer belt, and being in contact with the intermediate transfer belt from the inside of the closed path of said intermediate transfer belt, wherein said creep buckling area being a portion of said intermediate transfer belt between said backup roller and the first transfer area when said intermediate transfer belt stops, and said prescribed distance Ls satisfies the following conditions:

(1) where L5<L11/2, $$[(Vs\times t20+L8\times Vs/Vt)-L9+L7]<Ls<[(Vs\times t20+L8\times Vs/Vt)+L7];$$

and (2) L5>L11/2, $$[(Vs\times t20+L8+Vs/Vt)-L9+L7-L11]<Ls<[(Vs\times t20+L8\times Vs/Vt)+L7-L11],$$

where,

Ls=Vs×t30,

Vs: speed of movement of the intermediate transfer belt, t30: time between the detection of the belt mark by the belt mark detecting sensor and the stoppage of the belt, Vt: speed of movement of a photoreceptor surface on said continuous photoreceptor, t20: time between the detection of the belt mark by the belt mark detecting sensor and the commencement of exposure of the photoreceptor, L5: distance on the belt between the belt mark and the belt mark detecting sensor when the belt stops moving, measured along the direction of movement of the belt toward the downstream side, L7: distance on the belt between the belt mark detecting sensor and the backup roller, measured along the direction of movement of the belt toward the downstream side, L8: distance on the photoreceptor between its exposure position and the first transfer area, L9: length of the non-image formation area on the intermediate transfer belt, measured along the direction of movement of the belt, and L11: entire length of the intermediate transfer belt.

3. The intermediate transfer device according to claim 2, further comprising a second transfer device being located downstream from said first transfer device and facing said intermediate transfer belt from the outside of the closed path defining a second transfer area, wherein the toner images formed on said intermediate transfer belt transfer onto a recording medium fed between said intermediate transfer belt and said second transfer device.

4. The intermediate transfer device according to claim 3, further comprising a tension roller inside said intermediate transfer belt, said tension roller being movable in an outward direction pressing outward against said intermediate transfer belt for absorbing any elongation incurred by said intermediate transfer belt due to stretching.

5. The intermediate transfer device according to claim 2, wherein said belt mark detecting sensor comprises:

a light emission unit having a light-emitting diode and resistor element; and a light receiving unit having a photoresistor and resistor element, wherein a beam of light being projected from said light emission unit onto said intermediate transfer belt and reflected back to said light receiving unit, detects the existence of said belt mark.

6. The intermediate transfer device according to claim 3, further comprising:

a cleaner device located outside of the closed path of said intermediate transfer belt between said second transfer device and said backup roller, said cleaner device comprising a cleaning blade switchably in contact with said intermediate transfer belt, said blade removes residual toner existing on said intermediate transfer belt after the second transfer.

7. The intermediate transfer device according to claim 6, further comprising:

a separating device, being located downstream from said second transfer device outside of the closed path of said intermediate transfer belt, separates the recording medium on which the toner images have been transferred during the second transfer from said intermediate transfer belt.

8. An image-forming apparatus for forming images on a recording medium comprising an intermediate transfer device, said intermediate transfer device comprising:

a continuous intermediate transfer belt which travels along a closed path wound around rollers;

a continuous photoreceptor having toner images formed thereon, being driven to rotate by a power means, said continuous photoreceptor facing said intermediate transfer belt in a first transfer area;

a first transfer device which is located in said first transfer area, said first transfer device transferring the toner images on said photoreceptor onto said intermediate transfer belt;

a belt mark disposed on said intermediate transfer belt indicating a prescribed point on said intermediate transfer belt;

a belt mark detecting sensor for detecting said belt mark; and a control means for stopping said intermediate transfer belt when said intermediate transfer belt has traveled a prescribed distance Ls after the detection of said belt mark by said belt mark detecting sensor, wherein said prescribed distance Ls is set such that an area on said intermediate transfer belt susceptible for incurring creep buckling is prevented from passing the first transfer area while said first transfer device transfers the toner images onto said intermediate transfer belt.

9. The image-forming apparatus according to claim 8, further comprising:

a backup roller being located adjacent to and upstream from said first transfer area in terms of the direction of movement of the intermediate transfer belt, and being in contact with the intermediate transfer belt from the inside of the closed path of said intermediate transfer belt, wherein said creep buckling area being a portion of said intermediate transfer belt between said backup roller and the first transfer area when said intermediate transfer belt stops, and said prescribed distance Ls satisfies the following conditions:

(1) where L5<L11/2, $$[(Vs\times t20+L8\times Vs/Vt)-L9+L7]<Ls<[(Vs\times t20+L8\times Vs/Vt)+L7];$$

and (2) L5>L11/2, $$[(Vs\times t20+L8+Vs/Vt)-L9+L7-L11]<Ls<[(Vs\times t20+L8\times Vs/Vt)+L7-L11],$$

where,

Ls=Vs×t30,

Vs: speed of movement of the intermediate transfer belt, t30: time between the detection of the belt mark by the belt mark detecting sensor and the stoppage of the belt, Vt: speed of movement of a photoreceptor surface on said continuous photoreceptor, t20: time between the detection of the belt mark by the belt mark detecting sensor and the commencement of exposure of the photoreceptor, L5: distance on the belt between the belt mark and the belt mark detecting sensor when the belt stops moving, measured along the direction of movement of the belt toward the downstream side, L7: distance on the belt between the belt mark detecting sensor and the backup roller, measured along the direction of movement of the belt toward the downstream side, L8: distance on the photoreceptor between its exposure position and the first transfer area, L9: length of the non-image formation area on the intermediate transfer belt, measured along the direction of movement of the belt, and L11: entire length of the intermediate transfer belt.

10. The image-forming apparatus according to claim 9, further comprising a second transfer device being located downstream from said first transfer device and facing said intermediate transfer belt from the outside of the closed path defining a second transfer area, wherein the toner images formed on said intermediate transfer belt transfer onto a recording medium fed between said intermediate transfer belt and said second transfer device.

11. The image-forming apparatus according to claim 10, further comprising a tension roller inside said intermediate transfer belt, said tension roller being movable in an outward direction pressing outward against said intermediate transfer belt for absorbing any elongation incurred by said intermediate transfer belt due to stretching.

12. The image-forming apparatus according to claim 9, wherein said belt mark detecting sensor comprises:

a light emission unit having a light-emitting diode and resistor element; and a light receiving unit having a photoresistor and resistor element, wherein a beam of light being projected from said light emission unit onto said intermediate transfer belt and reflected back to said light receiving unit, detects the existence of said belt mark.

13. The image-forming apparatus according to claim 10, further comprising:

a cleaner device located outside of the closed path of said intermediate transfer belt between said second transfer device and said backup roller, said cleaner device comprising a cleaning blade switchably in contact with said intermediate transfer belt, said blade removes residual toner existing on said intermediate transfer belt after the second transfer.

14. The image-forming apparatus according to claim 13, further comprising:

a separating device, being located downstream from said second transfer device outside of the closed path of said intermediate transfer belt, separates the recording medium on which the toner images have been transferred during the second transfer from said intermediate transfer belt.

15. A method of forming an image on a recording medium using an intermediate transfer device in an image-forming apparatus, comprising the steps of:

driving an intermediate transfer belt having a closed path wound around a first transfer device having rollers, said first transfer device driving said intermediate transfer belt, and a belt mark disposed on said intermediate transfer belt for indicating a prescribed point on said intermediate transfer belt;

detecting said belt mark disposed on said intermediate transfer belt with a detecting sensor;

rotating a continuous photoreceptor powered by a power means, said continuous photoreceptor facing said intermediate transfer belt opposite said first transfer device defining a first transfer area;

transferring toner images formed on said continuous photoreceptor onto said intermediate transfer belt by said first transfer device at said first transfer area;

controlling the driving of said intermediate transfer belt, including stopping said intermediate transfer belt when said intermediate transfer belt has traveled a prescribed distance Ls after the detection of said belt mark by said belt mark detecting sensor;

electrographically transferring the toner images formed on said continuous photoreceptor onto said intermediate transfer belt in the first transfer area, wherein the prescribed distance Ls is set such that an area on said intermediate transfer belt susceptible for incurring creep buckling is prevented from passing the first transfer area while said continuous photoreceptor transfers the toner images onto said intermediate transfer belt.

16. The method according to claim 15, further comprising the steps of:

pressing a backup roller outward against said intermediate transfer belt, wherein said backup roller being located adjacent to and upstream from said first transfer area in terms of the direction of movement of the intermediate transfer belt, and being in contact with the intermediate transfer belt from the inside of the closed path of said intermediate transfer belt, wherein said creep buckling area being a portion of said intermediate transfer belt between said backup roller and the first transfer area when said intermediate transfer belt stops, and said prescribed distance Ls satisfies the following conditions:

(1) where L5<L11/2, $$[(Vs\times t20+L8\times Vs/Vt)-L9+L7]<Ls<[(Vs\times t20+L8\times Vs/Vt)+L7];$$

and (2) L5>L11/2, $$[(Vs\times t20+L8+Vs/Vt)-L9+L7-L11]<Ls<[(Vs\times t20+L8\times Vs/Vt)+L7-L11],$$

where,

Ls=Vs×t30,

Vs: speed of movement of the intermediate transfer belt, t30: time between the detection of the belt mark by the belt mark detecting sensor and the stoppage of the belt, Vt: speed of movement of a photoreceptor surface on said continuous photoreceptor, t20: time between the detection of the belt mark by the belt mark detecting sensor and the commencement of exposure of the photoreceptor, L5: distance on the belt between the belt mark and the belt mark detecting sensor when the belt stops moving, measured along the direction of movement of the belt toward the downstream side, L7: distance on the belt between the belt mark detecting sensor and the backup roller, measured along the direction of movement of the belt toward the downstream side, L8: distance on the photoreceptor between its exposure position and the first transfer area, L9: length of the non-image formation area on the intermediate transfer belt, measured along the direction of movement of the belt, and L11: entire length of the intermediate transfer belt.

17. The method according to claim 16, further comprising the steps of:

transferring the toner images formed on said intermediate transfer belt to a recording medium in a second transfer area located downstream from said first transfer area in terms of the direction of movement of said intermediate transfer belt by pressing a second transfer device against said intermediate transfer belt, said second transfer device being located downstream from said first transfer device and facing said intermediate transfer belt from the outside of the closed path defining the second transfer area, wherein the recording medium is fed between said intermediate transfer belt and said second transfer device.

18. The method according to claim 17, further comprising the steps of:

pressing a tension roller outward against said intermediate transfer belt, said tension roller being located inside said intermediate transfer belt and being movable in an outward direction pressing outward against said intermediate transfer belt for absorbing any elongation incurred by said intermediate transfer belt due to stretching.

19. The method according to claim 16, whereby the method of detecting said belt mark on said intermediate transfer belt further comprises the steps of:

projecting a beam of light from a light emission unit having a light-emitting diode and resistor element; and receiving the beam of light after being reflected back from said intermediate transfer belt using a light receiving unit, having a photoresistor and resistor element.

20. The method according to claim 17, further comprising the steps of:

cleaning said intermediate transfer belt using a cleaner device located outside of the closed path of said intermediate transfer belt between said second transfer device and said backup roller, said cleaner device comprising a cleaning blade switchably in contact with said intermediate transfer belt, wherein said blade removes residual toner existing on said intermediate transfer belt after the second transfer.

21. The method according to claim 20, further comprising the steps of:

separating the recording medium from said intermediate transfer belt using a separating device located downstream from said second transfer device outside of the closed path of said intermediate transfer belt, wherein said separating device separates the recording medium on which the toner images have been transferred during the second transfer from said intermediate transfer belt.

22. An image forming apparatus for forming images on a recording medium comprising:

a photoreceptor drum which receives toner images;

an intermediate transfer member having a portion which receives said toner images from said photoreceptor drum and provides said toner images to said recording medium, and said intermediate transfer member having a mark on a surface thereof;

a detector which detects said mark;

a drive mechanism which drives said intermediate transfer member to move, said drive mechanism at least one drive roller; and a controller which controls said drive mechanism to move said intermediate transfer member based on the detection of said mark by said detector such that the portion which receives said toner images does not stop when positioned over said at least one drive roller.

* * * * *